US006153572A

United States Patent [19]

Stamm

[11] Patent Number: 6,153,572

[45] **Date of Patent: *Nov. 28, 2000**

[54] ACIDIC LIQUID TOILET BOWL CLEANER

[75] Inventor: Charles L. Stamm, Kentwood, Mich.

[73] Assignee: Amway Corporation, Ada, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 09/033,844

[22] Filed: Mar. 3, 1998

[51] Int. Cl.[7] ..... C11D 1/72; C11D 1/75; C11D 3/20; C11D 3/22

[52] U.S. Cl. ..... 510/193; 510/191; 510/199; 510/238; 510/421; 510/423; 510/433; 510/434; 510/470; 510/473; 510/477; 510/488

[58] Field of Search ..... 510/191, 193, 510/199, 238, 421, 423, 433, 434, 470, 473, 477, 488

[56] References Cited

U.S. PATENT DOCUMENTS

| | | | |
|---|---|---|---|
| 4,435,303 | 3/1984 | Abadi | 510/248 |
| 5,232,632 | 8/1993 | Woo et al. | 510/406 |
| 5,413,727 | 5/1995 | Drapier et al. | 510/223 |
| 5,472,629 | 12/1995 | Lysy et al. | 510/238 |
| 5,597,789 | 1/1997 | Sadlowski | 510/230 |
| 5,797,986 | 8/1998 | Rolando et al. | 134/6 |

*Primary Examiner*—Gregory R. Delcotto
*Attorney, Agent, or Firm*—Brinks Hofer Gilson & Lione

[57] ABSTRACT

A toilet bowl cleaner having an acid value from about 50 to about 90 includes a nonionic surfactant, a carboxylic acid, and a thickener. Preferably, the thickener is an acrylic copolymer and the acid is glycolic acid. The composition is concentrated to maintain cleaning effectiveness in a dilute environment.

2 Claims, No Drawings

ACIDIC LIQUID TOILET BOWL CLEANER

BACKGROUND OF THE INVENTION

Toilet bowl cleaners are particularly difficult to design due to the nature of their application and use. An effective cleaner must have sufficient cleaning strength when diluted in the toilet bowl to dissolve and remove scale. In addition, the cleaner must be able to cling to the vertical walls of the bowl. Toilet bowl cleaners may contain mineral acids and have acid values of 140 or more. Unfortunately, these mineral acids can corrode and degrade delicate surfaces and irritate the skin of the user. Toilet bowl cleaners may also contain organic acids and have acid values of 45 or less. However, even though these cleaners create highly acidic conditions, they do not adequately attack scale and require a great deal of time and effort to effectively clean a bowl.

Several patents describe cleaning compositions; however, each of them has several shortcomings. For example, U.S. Pat. No. 5,322,635 to Hieatt is directed to a soap composition. However, this composition does not effectively clean and dissolve scale nor is it able to cling to the vertical walls of the bowl. U.S. Pat. No. 4,269,723 to Barford et al. is directed to a particulate material and solid tablets that slowly dissolve in the cistern of a toilet bowl. This material is a slow acting cleaner and does not facilitate the active scouring of a bowl.

Thus, there is a need in the art for a liquid toilet bowl cleaner that is faster acting, safer and thicker than previous compositions. The cleaner must be a quick and effective means of cleaning a toilet bowl and dissolving lime scale. It must not be corrosive to delicate surfaces or initially irritating to the user. It must also cling to the vertical walls of the bowl and maintain sufficient contact time.

SUMMARY OF THE INVENTION

The toilet bowl cleaner of the present invention solves these problems by providing a toilet bowl cleaner having a viscosity of about 50–200 cps. The cleaner includes a nonionic surfactant and an organic carboxylic acid. Surprisingly, the cleaner is at least as effective as prior art compositions but does not exhibit the corrosiveness commonly found in prior art cleaners.

In one embodiment of the present invention the toilet bowl cleaner includes from about 0.75% to about 1.25% nonionic surfactant, and from about 9% to about 10% organic carboxylic acid. Preferably, the cleaner also includes from about 0.75% to about 1.25% acrylic copolymer.

The present invention also includes a method of cleaning a toilet bowl that comprises applying a cleaner of the present invention to the inside side walls of a toilet bowl and cleaning the bowl.

Unless otherwise stated, all percentages stated in this specification and appended claims refer to percentages by weight.

DETAILED DESCRIPTION OF THE PREFERRED EMBODIMENT

The toilet bowl cleaner of the present invention has an acid value between 50 and 90 and includes a nonionic surfactant, an organic acid, and a thickener. Each ingredient will be further described below.

Nonionic Surfactant

A nonionic surfactant is provided to wet the surface of the bowl quickly and assist in cleaning performance. Nonlimiting examples of suitable nonionic surfactants that may be used in the present invention are as follows:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with an average of 9.5 moles of ethylene oxide per mole of nonyl phenol; dodecylphenol condensed with an average of 12 moles of ethylene oxide per mole of phenol; dinonyl phenol condensed with an average of 15 moles of ethylene oxide per mole of phenol and diisooctyl phenol condensed with an average of 15 moles of ethylene oxide per mole of phenol.

(2) The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Preferably, a 12–15 carbon alcohol is ethoxylated with an average of 3–15 moles of ethylene oxide, more preferably an average of about 7 moles of ethylene oxide. Examples of such ethoxylated alcohols include the condensation product of myristyl alcohol condensed with an average of 10 moles of ethylene oxide per mole of alcohol; the condensation product of an average of 9 moles of ethylene oxide with coconut alcohol (a mixture of fatty alcohols with alkyl chains varying in length from about 10 to 14 carbon atoms); and the condensation product of undecanol with an average of 7 moles of ethylene oxide.

(3) The condensation products of ethylene oxide with a hydrophobic base formed by the condensation of propylene oxide with propylene glycol. The hydrophobic portion of these compounds has a molecular weight of from about 1500 to 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide.

(4) The condensation of ethylene oxide with the product resulting from the reaction of propylene oxide and ethylenediamine. The hydrophobic moiety of these products consists of the reaction product of ethylenediamine and excess propylene oxide, the moiety having a molecular weight of from about 2500 to about 3000. This hydrophobic moiety is condensed with propylene oxide to the extent that the condensation product contains from about 40% to about 80% by weight of polyoxyethylene and has a molecular weight of from about 5,000 to about 11,000.

(5) Amido amine oxides comprising compounds and mixtures of compounds having the formula:

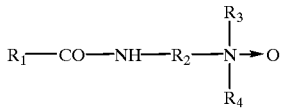

wherein $R_1$ is a $C_8$–$C_{18}$ alkyl, $R_2$ is a $C_2$–$C_4$ alkyl and $R_3$ and $R_4$ are a $C_1$–$C_5$ alkyl or hydroxyalkyl. Examples of amido amine oxides which may be useful in the present invention include, but are not limited to, babassuamidopropyl amine oxide, cocoamidopropyl amine oxide, isostearylamidopropyl amine oxide, isostearylamidopropyl morpholine oxide, lauramidopropyl amine oxide, minkamidopropyl amine oxide, oleoamidopropyl amine oxide, olivamidopropyl amine oxide, sesamidopropyl amine oxide, stearamidopropyl amine oxide and wheat germ amidopropyl amine oxide.

The nonionic surfactant will generally be present at a level of about 0.05% to about 20% by weight, preferably in the range of about 0.1% to about 15%, and more preferably in the range of about 0.75% to about 1.25%. Preferably the nonionic surfactant is a 12–15 carbon alcohol, ethoxylated with an average of about 3–15 moles of ethylene oxide, most preferably it is ethoxylated with an average of about 7 moles of ethylene oxide. In a preferred embodiment the nonionic surfactant is a 12–15 carbon alcohol ethoxylated with an average of about 7 moles of ethylene oxide and comprises about 1% of the cleaner.

Carboxylic Acid

The carboxylic acid of the present invention is of such character and sufficient quantity to provide an acid value from about 50 to about 90. Non-exclusive examples of carboxylic acids useful in the present invention are acetic, citric, lactic, tartaric and glycolic acid. Preferably, the carboxylic acid contains no more than about 6 carbon atoms. More preferably, the carboxylic acid is a monocarboxylic, and even more preferably is a hydroxy monocarboxylic acid having up to 4 carbon atoms. Glycolic acid is the most preferred acid.

The acid is present in an amount necessary to effectively clean the toilet bowl and create an acid value from about 50 to about 90. Preferably the acid concentration is from about 1% to about 50%; more preferably from about 3% to about 20%. The most preferred acid concentration is about 9.5% glycolic acid because at this concentration the formula is a highly effective cleaner and is non-corrosive.

The acid value of the cleaner is the number of milligrams of potassium hydroxide necessary to neutralize the fatty acids in a 1 gram sample of the cleaner. The method used is AOCS Official Method Te 1a-64.

Thickener

Preferably, a thickener is added to the toilet bowl cleaner of the present invention to enable the cleaner to cling to the side walls of the toilet bowl. Having the cleaner cling to the toilet bowl maximizes the time that the cleaner is in contact with the lime scale and other deposits. If no thickener is used the cleaner runs down the side of the toilet bowl too quickly without effectively cleaning the surface. However, if the cleaner becomes too thick the product loses cleaning performance and the aesthetics are compromised. Consequently, it is preferable for the toilet bowl cleaner of the present invention to have a viscosity of from about 10 cps to about 750 cps. More preferably, the viscosity is from about 30 cps to about 500 cps. In the most preferred embodiment the viscosity is about 150 cps.

The cleaning composition of the present invention may be thickened with any means for thickening the composition to an acceptable viscosity. Non-exclusive examples of thickeners are acrylic copolymers, Xanthan gum, substituted cellulose materials, and polysaccharides. Preferably the thickener is an acrylic copolymer present in an amount between about 0.75% and 1.25%. In the most preferred embodiment the thickener comprises about 1% of the cleaner and is an acrylic copolymer supplied by ALCO Chemical under the trade name ALCOGUM L-511. This polymer is described in U.S. patent application Ser. No. 08/698,690, which is hereby incorporated by reference in its entirety.

Additives

The cleaner of the present invention, while a novel and needed advance in the art, is relatively simple in its formulation and does not implicate complex chemical synthesis. For example, complicated surfactants, such as zwitterionic and amphoteric surfactants are not needed in the cleaners of the present invention in order to be effective.

Other ingredients such as pH adjusters, stabilizing agents, preservatives, fragrances and dyes may be included in the liquid cleaning composition of the present invention, so long as they do not detract from the advantages resulting from the compositions of the present invention. Stabilizing agents may be included to achieve phase stability, pH balance and other desired characteristics. Commonly used hydrotropes can include mono, di and triethanolamine.

The pH of the liquid cleaner is in the range of about 1 to about 4. More preferably the pH is in the range of about 2 to about 3. A composition with a pH below about 2 is very corrosive while a composition with a pH above about 4 may not be effective in removing lime scale. Agents for controlling the pH may, but do not have to, be included. Non-limiting examples are carbonates and bicarbonates, mono, di and triethanolamine and alkali metal hydroxides. The mono, di and triethanolamines are preferred. Most preferred as both a stabilizing agent and a pH controlling agent is triethanolamine.

Fragrance can also be added in an amount up to about 1%.

Water comprises the balance of the liquid cleaning composition. Accordingly, the liquid cleaning composition of the present invention contains from about 50% to about 99% water.

The cleaning compositions described above are particularly useful in cleaning toilet bowls. The cleaner may be applied to the bowl through the use of either a spray bottle or a squeezable squirt bottle. Preferably, the cleaner is allowed to remain on the bowel for a period of time that is sufficient to dissolve the scale on the bowl. The bowl is then cleaned with a brush or other suitable instrument to remove the cleaner and dissolved scale.

EXAMPLES

The following examples illustrate the effectiveness of the cleaning compositions of the present invention. Table 1 details the characteristics of five cleaning compositions. Each cleaner was tested for its effectiveness in dissolving lime scale by submersing 0.6 grams of white chalk in 30 ml of cleaner. The cleaners were tested in both their undiluted form and, in order to simulate practical conditions, in a 50/50 dilution of cleaner to water. As Table 1 demonstrates, a cleaning composition having an acid value from about 50 to about 90 is a highly effective cleaner. Examples 1 and 5 are within the scope of the present invention.

TABLE 1

| Example | Acid | Acid Value | pH | Destruction Time Undiluted | Destruction Time Diluted |
|---|---|---|---|---|---|
| 1 | 9.5% Glycolic | 72.5 | 2.2 | 39 Min. | 31 Min. |
| 2 | 9.5% Hydrochloric | 153.1 | 0.5 | 24 Min. | 30 Min. |
| 3 | 2.5% Citric | 25.4 | 1.8 | >75 Min. | >75 Min. |
| 4 | 2.2% Citric/4.0 Lactic | 39.9 | 3.0 | >75 Min. | >75 Min. |
| 5 | 8% Maleic | 78.9 | 1.6 | 27 Min. | 58 Min. |

Surprisingly, the cleaning effectiveness of Example 1 actually improves in a dilute environment. In comparison, Example 2 contains the same amount of acid as Example 1, but substitutes hydrochloric acid for glycolic acid. The product dissolves chalk quicker; however, its pH is significantly lower, the acid value is significantly higher and is, consequently, highly corrosive. Example 3, despite having a lower pH, is not nearly as effective as Example 1.

A comparison of Example 5 to Example 1 reveals the benefits of a hydoxy monocarboxylic acid. While Example 5 is a very effective cleaner, when diluted it does not dissolve lime scale as quickly as Example 1, despite having a lower pH and higher acid value. As a result, while Example 5 is an embodiment of the present invention, Example 1 is more preferred.

Of course, it should be understood that a wide range of changes and modifications can be made to the embodiments described above. It is intended, therefore, that the foregoing description illustrates rather than limits this invention, and that it is the following claims, including all equivalents, that define this invention.

What is claimed is:

1. A toilet bowl cleaner consisting of from about 0.75% to about 1.25% of a nonionic surfactant; from about 9% to about 10% of a carboxylic acid; from about 0.75% to about 1.25% of a thickener; a dye; up to about 1% of a fragrance; and water.

2. A toilet bowl cleaner consisting of:

a. about 0.75% of a nonionic surfactant consisting of an ethoxylated aliphatic alcohol;

b. about 9.5% of a monocarboxylic acid;

c. about 0.8% of an acrylic copolymer;

d. a dye;

e. up to about 1% of a fragrance; and f. water.

* * * * *